United States Patent [19]

Hogue et al.

[11] 4,342,170

[45] Aug. 3, 1982

[54] FASTENER FOR UNITARY PISTOL HAND GRIP

[75] Inventors: Guy L. Hogue, Atascadero; James D. Mason, San Diego, both of Calif.

[73] Assignee: Hogue Combat Grips, Inc., Los Osos, Calif.

[21] Appl. No.: 178,948

[22] Filed: Aug. 18, 1980

[51] Int. Cl.[3] ..... F41C 23/00

[52] U.S. Cl. ..... 42/71 P

[58] Field of Search ..... 42/71 P; 308/15, 18, 308/20, 30; 248/266

[56] References Cited

U.S. PATENT DOCUMENTS

| | | | |
|---|---|---|---|
| 819,197 | 5/1906 | Agin et al. | 248/266 |
| 4,199,887 | 4/1980 | Hogue | 42/71 P |
| 4,276,709 | 7/1981 | Bross | 42/71 P |

*Primary Examiner*—Charles T. Jordan

*Attorney, Agent, or Firm*—Brown & Martin

[57] ABSTRACT

A fastener for fastening a unitary hand grip to a pistol having a butt frame section with downwardly extending front and rear butt portions that are interconnected at their lower ends by a foot portion. One embodiment of the fastener has a yoke straddling the foot portion of the butt section, a pin extending between the openings in the upper sides of the yoke above the foot portion, a roller on the pin, and a screw for attaching the bottom of the yoke to the bottom of the unitary hand grip. The upper sides of the yoke contain concave depressions or dimples around the pin openings and the pin is dimensioned to be flush with the side edges of the yoke. The inside of the unitary hand grip is close to the outer side edges of the yoke and the concave depressions plus the length of the pin and the nearness of the wall of the hand grip prevent the pin from being dislodged from the yoke, even by heavy use of the pistol or from other shocks encountered in use.

9 Claims, 12 Drawing Figures

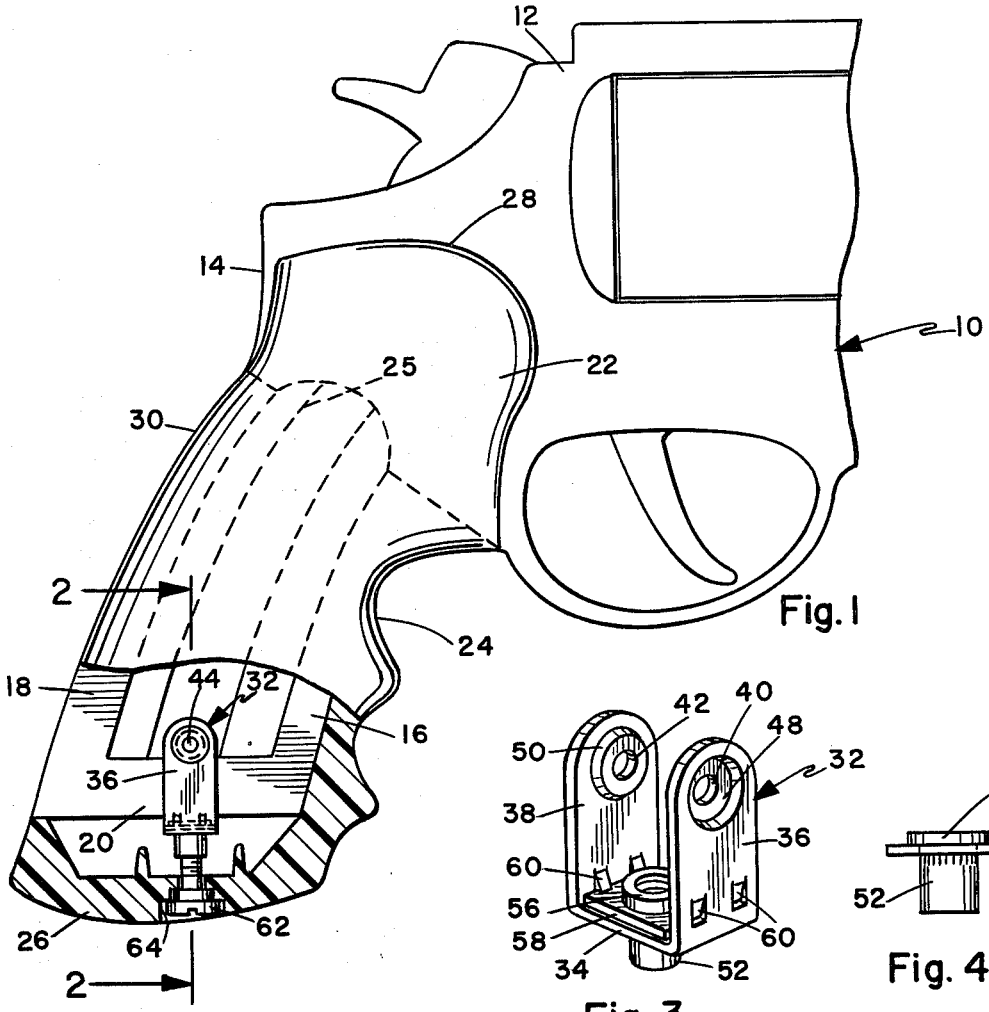
Fig. 1
Fig. 3
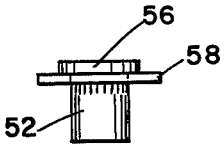
Fig. 4
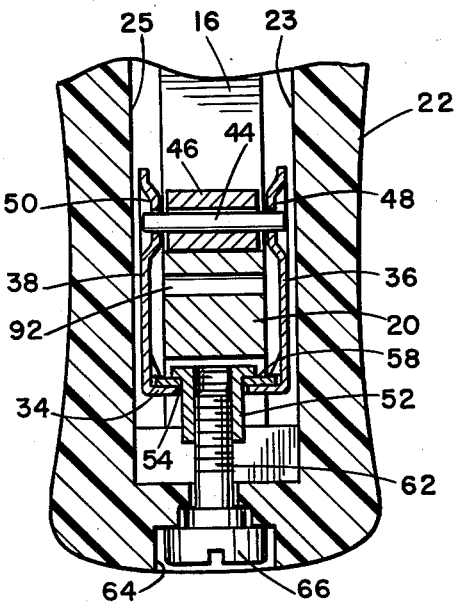
Fig. 2
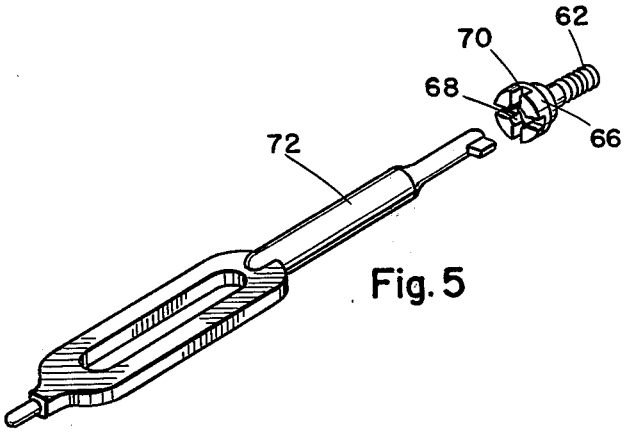
Fig. 5

FASTENER FOR UNITARY PISTOL HAND GRIP

BACKGROUND OF THE INVENTION

Pistols in general have a frame with a butt section which is cut out for lightness and to accommodate the firing spring used in most pistons, leaving downwardly extending front and rear frame members which are interconnected at their lower ends by a foot portion. U.S. Pat. No. 4,199,887 discloses a unitary hand grip which covers the butt frame section of a pistol and is secured thereto by fastener means which includes a yoke straddling the foot of the butt frame section, means for securing the top of the yoke to the foot, and screw means attaching the bottom of the yoke to the bottom of the unitary hand grip. In one form of the fastener, the yoke has an open top, and a roller which rides on the top of the foot is rotatably mounted across the open top of the yoke by means of a pin which is engaged in openings in the upper sides of the yoke adjacent to the open top. It has been found, however, that the kick due to firing the pistol and other shocks received during use, tend to dislodge the pin upon which the roller is mounted and to disconnect the pin from one side of the yoke, thereby disconnecting one side of the yoke from the foot of the butt frame section and thus allowing the grip to move when the pistol is fired. This, of course, decreases the accuracy of the pistol.

SUMMARY OF THE INVENTION

The preferred embodiment of the fastener described herein has a yoke straddling the foot portion of the butt section, a pin extending between openings in the upper sides of the yoke above the foot portion, and screw means for attaching the bottom of the yoke to the bottom of the unitary hand grip. The upper sides of the yoke contain concave depressions or dimples around the pin openings and the pin is dimensioned to be flush with the outer side edges of the yoke. The inside of the unitary hand grip is close to the outer side faces of the yoke, and the concave depressions plus the length of the pin and the nearness of the walls of the hand grip prevent the pin from being dislodged from the yoke, even by heavy use of the pistol or by other shocks encountered in use. In an alternate embodiment of the invention, dislodgement of the pin is obviated by using a C-shaped fastener member having an upper cross bar seated on the foot portion, a lower cross bar extending below the foot portion, and screw means for fastening the bottom of the unitary hand grip to the lower cross bar.

The principal object of this invention is to provide a fastener for unitary pistol hand grips which will remain securely fastened under conditions of heavy use.

Another object of this invention is to provide a fastener for unitary pistol hand grips which is sturdier and less expensive than those heretofore known in the art.

Other objects and advantages of the invention will be apparent from the detailed description herein.

BRIEF DESCRIPTION OF THE DRAWINGS

FIG. 1 is a side elevation view of the butt section of a pistol having a unitary hand grip, the lower portion of the hand grip being cut away to reveal the preferred embodiment of the invention.

FIG. 2 is a sectional view taken on the line 2—2 of FIG. 1.

FIG. 3 is a perspective view of the yoke used in the preferred embodiment of the invention.

FIG. 4 is a side elevation view of the threaded sleeve used in the preferred embodiment of the invention.

FIG. 5 shows a fastening screw which is adapted to be turned by a standard handcuff key.

DESCRIPTION OF THE PREFERRED EMBODIMENT

Figure 6:
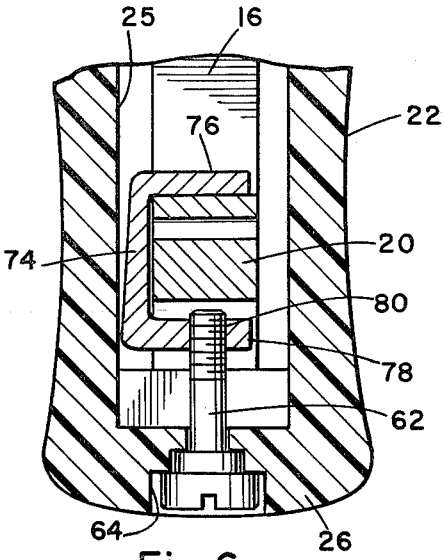
FIG. 6 is a sectional view similar to FIG. 2, utilizing an alternate embodiment of the invention having a C-shaped fastener member.

FIG. 1 illustrates the butt portion of a pistol 10 having a frame 12 with a butt portion 14. The frame butt portion 14 is cut out for lightness and to accommodate the firing spring used in most pistols, leaving a downwardly extending front frame member 16, a downwardly extending rear frame member 18, and a foot portion 20 interconnecting the lower ends of the frame members. A unitary hand grip 22, which has a closed front 24, a closed bottom 26, an open top 28, and an open rear 30, snugly covers the frame butt portion 14. The unitary hand grip 22 can be made of wood, plastic, or any other suitable material.

The preferred form of the fastener is shown in FIGS. 1 to 5 and includes a yoke 32 having a lower cross bar 34 and two upwardly extending sides 36 and 38 spaced to straddle the foot portion 20. Two coaxial openings 40 and 42 are formed in the upper portions of the sides 36 and 38 to receive a pin 44, which rotatably supports a roller 46. Roller 46 rides on top of the foot portion 20 and permits the fastener to move along the top of the foot portion 20 when the unitary hand grip 22 is being installed. Two concave depressions or dimples 48 and 50 are formed in the sides 36 and 38 of yoke 32 around openings 40 and 42, and the pin 44 is dimensioned to fit flush with the outside surface of sides 36 and 38. The hand grip has opposed internal channels 23 and 25 extending from near the top to the bottom portion 26, the sides 36 and 38 of the yoke sliding in the channels, as shown in FIG. 2. The depressions 48 and 50 and the length of the pin 44 prevent the pin from being dislodged from the yoke 32 by any type of shock, since there is not enough room between the walls of channels 23 and 25 for pin 44 to escape from the holes 40 and 42.

The yoke 32 is attached to the bottom of the unitary hand grip 22 by screw means illustrated in FIGS. 3 and 4, which includes a threaded sleeve 52 projecting through a hole 54 in the bottom of the cross bar 34. The threaded sleeve 52 has a flange 56 on its upper end and is press fitted through an opening in a square insert 58. The insert 58 is staked to the bottom of the yoke 32 by stake punches 60 in the lower portion of the yoke sides 36 and 38.

A screw 62 extends through an opening 64 in the bottom 26 of the unitary hand grip 22 and engages in the threads of the threaded sleeve 52 to attach the hand grip to the yoke 32. The head 66 of the screw 62 has a central socket 68 and radial slots 70 to adapt the screw to be turned by the compatible end of a conventional handcuff key 72, as in FIG. 5. This enables a police officer to remove the unitary hand grip 22 from a pistol for the purposes of cleaning the pistol, without requiring a screwdriver. The radial slots 70 are aligned with each other so that the screw 62 can also be turned with a conventional screwdriver.

Figure 7:
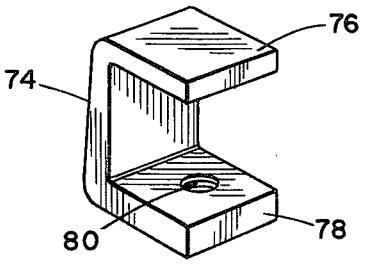
FIG. 7 is a perspective view of the C-shaped fastener member shown in FIG. 6.

FIGS. 6 and 7 show an alternate fastener which obviates the problem of dislodging the pin 44 by dispensing with the pin 44. This alternate fastener is a C-shaped fastener member 74 having an upper cross bar 76 which rests on top of the foot portion 20 and a lower cross bar 78 which extends below the foot portion 20. The lower cross bar 78 has a threaded opening 80 for receiving screw 62.

Figure 8:
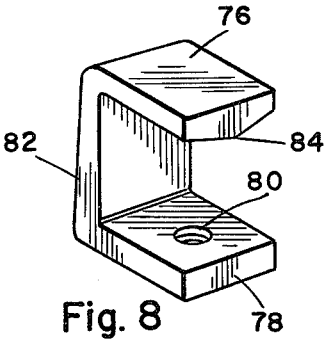
FIG. 8 is a perspective view of a first modified form of the C-shaped fastener member.
Figure 9:
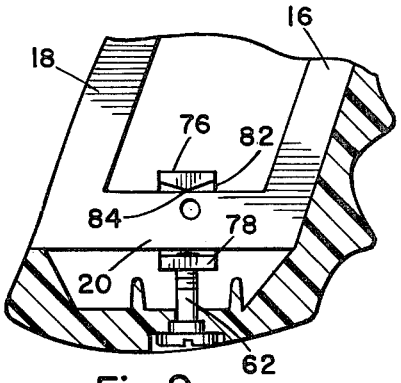
FIG. 9 is a cross sectional view similar to a portion of FIG. 1, showing the use of the C-shaped fastener member of FIG. 8.

FIGS. 8 and 9 show a modified C-shaped member 82 similar to member 74, except that the upper cross bar 76 has a V-shaped lower surface 84 to provide a rocking alignment action on top of the foot portion 20 when screw 62 is being tightened.

Figure 10:
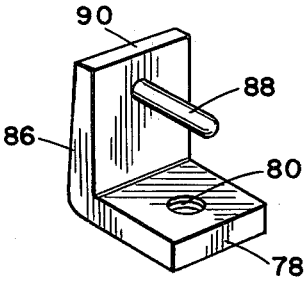
FIG. 10 is a perspective view of a second modified form of the C-shaped fastener.
Figure 11:
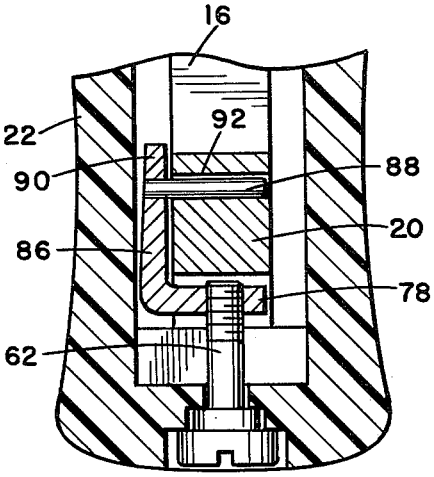
FIG. 11 is a sectional view similar to FIG. 6, showing the use of the C-shaped fastener member of FIG. 10.

FIGS. 10 and 11 show a second modified C-shaped member 86 wherein the upper cross bar is replaced by a pin 88 which is press fitted into an opening in the upper side portion 90 of the member. Foot portion 20 has a hole 92 into which pin 88 fits, the hole being standard in most pistols to receive alignment pins on conventional individual butt plates.

Figure 12:
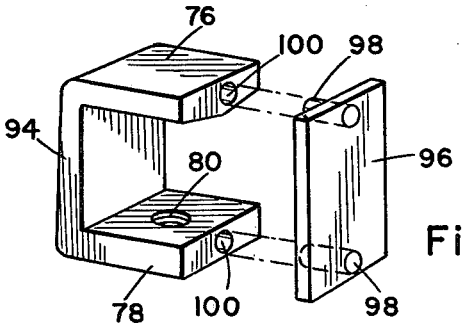
FIG. 12 illustrates a modified form of the fastener member of FIG. 8.

The fastener member 94 illustrated in FIG. 12 is similar to member 82 in FIG. 8, but is used in conjunction with a retaining plate 96 which has pins 98 projecting from one side. The upper cross bar 76 and lower cross bar 78 have sockets 100 to receive pins 98, so that the retaining plate closes the open side of the fastener and thus wraps the fastener completely around foot portion 20. This arrangement would add strength to the fastener and allow it to be made of plastic material which might otherwise be deformed by the clamping action. It should be noted that the retaining plate is also applicable to the fastener member 74 of FIG. 7.

Having described my invention I claim:

1. A fastener for use in combination with a pistol having a cut out butt frame portion with downwardly extending front and rear members and a foot portion extending between the lower ends of said front and rear members, and a unitary hand grip covering said butt frame section, said unitary hand grip having a closed bottom with an opening therein, the fastener comprising:

a yoke having a cross bar below said foot portion and having two upwardly extending side portions straddling the foot portion;

an opening in the upper end of each side portion of said yoke;

a pin extending transversely across the top of said foot portion and engaged in said openings in said side portions of the yoke, the ends of said pin being substantially flush with the outside surfaces of said side portions;

a roller rotatably mounted on said pin and riding on top of said foot portion;

inwardly concave opposed depressions formed in the side portions of said yoke around said openings therein to prevent said pin from disengaging from said yoke;

a threaded sleeve attached to said cross bar and extending downwardly therefrom;

a screw extending through said opening in the bottom of said hand grip and engaging in said threaded sleeve.

2. The fastener defined in claim 1 and also including an insert on top of said cross bar, there being a hole in said insert and said cross bar, said sleeve being press fitted through said hole and having a flange seating on said insert.

3. The fastener defined in claim 2 wherein said insert is staked to the bottom of said yoke above said cross bar.

4. The fastener defined in claim 1 wherein the head of said screw has a central socket and radial slots to receive a compatible end of a handcuff key.

5. A fastener for use in combination with a pistol having a cut out butt frame portion with downwardly extending front and rear members and a foot portion extending between the lower ends of said front and rear members, and a unitary hand grip covering said butt frame section, said unitary hand grip having a closed bottom, the fastener comprising:

a C-shaped fastener member having an upper cross bar seated on top of said foot portion and a lower cross bar extending below said foot portion;

and screw means for fastening the bottom of said hand grip to said lower cross bar.

6. The fastener defined in claim 5 wherein the lower surface of said upper cross bar is substantially V-shaped to provide a rocking action on top of said foot portion.

7. The fastener defined in claim 5 wherein there is a pin hole through said foot portion and said upper cross bar is a pin extending through said pin hole.

8. The fastener defined in claim 5 wherein said screw means comprises a threaded opening in said lower cross bar, an opening in the bottom of said unitary hand grip, and a screw extending through said opening and engaged in said threaded opening in said cross bar.

9. The fastener defined in claim 5, and including a retaining plate having a pair of spaced pins projecting from one side;

said upper and lower cross bars each having a socket to receive one of said pins with the retaining plate connecting the cross bars.

* * * * *